US005147602A

United States Patent [19]

Andresen et al.

[11] Patent Number: 5,147,602

[45] Date of Patent: Sep. 15, 1992

[54] CORROSION RESISTANT HIGH CHROMIUM STAINLESS STEEL ALLOY

[75] Inventors: Peter L. Andresen; Leonard W. Niedrach, both of Schenectady, N.Y.

[73] Assignee: General Electric Company, Schenectady, N.Y.

[21] Appl. No.: 703,325

[22] Filed: May 20, 1991

[51] Int. Cl.[5] ..... C22C 38/40; C22C 30/00

[52] U.S. Cl. ..... 420/35; 420/54; 420/584.1

[58] Field of Search ..... 420/35, 54, 584

[56] References Cited

U.S. PATENT DOCUMENTS

| | | | |
|---|---|---|---|
| 2,661,284 | 12/1953 | Nisbet | 420/54 |
| 4,384,891 | 5/1983 | Barnabé | 420/35 |
| 4,836,976 | 6/1989 | Jacobs | 376/305 |
| 4,842,811 | 6/1989 | Desilva | 376/301 |

FOREIGN PATENT DOCUMENTS

| | | | |
|---|---|---|---|
| 0145262 | 6/1985 | European Pat. Off. . | |
| 0235954 | 3/1987 | European Pat. Off. . | |
| 1210496 | 2/1966 | Fed. Rep. of Germany . | |
| 51-45612 | 4/1976 | Japan | 420/54 |
| 55-89459 | 7/1980 | Japan | 420/35 |
| 56-96052 | 8/1981 | Japan | 420/54 |
| 56-150167 | 11/1981 | Japan | 420/54 |
| 1170455 | 11/1969 | United Kingdom . | |

OTHER PUBLICATIONS

"Hydrogen Water Chemistry Technology for BWRs", J. N. Kass, R. L. Cowan, Proceedings of the Second International Symposium on Environmental Degradation of Materials in Nuclear Power Systems-Water Reactors, American Nuclear Society, 1986, pp. 211-217.

"Water Chemistry of Nuclear Power Plants", W. T. Lindsey, Jr., Proceedings of the Second International Symposium on Environmental Degradation of Materials in Nuclear Power Systems-Water Reactors, American Nuclear Society, 1986, pp. 203-210.

"Platinum Metals in Stainless Steels", I. R. McGill, Platinum Metals Review, 1990, vol. 34 (2), pp. 85-97.

"Alloying Stainless Steels with the Platinum Metals", M. A. Streicher, Platinum Metals Review, 1977, vol. 21, pp. 51-55.

"Development of Pitting Resistant Fe-Cr-Mo Alloys", M. S. Streicher, Corrosion-Nace, vol. 30, No. 3, Mar., 1974, pp. 77-91.

"Increasing the Passivation Ability and Corrosion Resistance of Chromium Steel by Surface Alloying with Palladium", G. P. Chernova, T. A. Fedoseeva, L. P. Kornienko, N. D. Tomashov, Surface Technology, vol. 13, 1981, pp. 241-256.

"Increasing the Passivability and Corrosion Resistance of Stainless Steels by Surface Alloying with Palladium", Chernova, G. P. et al., Plenum Publishing Corporation, UDC 620.197.3 (1982) pp. 406-411.

"Protective Coatings for Radiation Control in Boiling Water Nuclear Power Reactors", T. V. Rao, R. W. Vook, W. Meyre, and C. Wittwer, J. Vac. Sci. Technol. A 5 (4) (Jul./Aug. 1987) pp. 2701-2705.

"Palladium Impedes Radionuclide Pick-Up in Steel", Platinum Metals Rev 33[4] (1989) p. 185.

"Thin Films to Impede the Incorporation of Radionuclides in Austenitic Stainless Steels", H. Ocken et al., Elsevier Sequoia, printed in The Netherlands (1989) pp. 323-334.

*Primary Examiner*—Deborah Yee

*Attorney, Agent, or Firm*—James F. McGinness; James C. Davis, Jr.; James Magee, Jr.

[57] ABSTRACT

A high-chromium stainless steel alloy having improved resistance to stress corrosion cracking in high temperature water is comprised of, in weight percent; about 22 to 32 percent chromium, about 16 to 40 percent nickel, up to about 10 percent manganese, up to about 0.06 percent carbon, and the balance substantially iron. A preferred high-chromium alloy is further comprised of about 2 to 9 weight percent of a metal from the group consisting of titanium, niobium, tantalum, and mixtures thereof. Another preferred high-chromium alloy is further comprised of a platinum group metal in an effective amount to reduce the corrosion potential of the alloy in high-temperature water provided with hydrogen.

2 Claims, 7 Drawing Sheets

CORROSION RESISTANT HIGH CHROMIUM STAINLESS STEEL ALLOY

CROSS-REFERENCE TO RELATED APPLICATION

This application relates to copending applications Ser. No. 07/502,721, filed Apr. 2, 1990; Ser. No. 07/502,720, filed Apr. 2, 1990; and Ser. No. 07/698,885, filed May 13, 1991 each incorporated herein by reference.

BACKGROUND OF THE INVENTION

This application relates to stainless steel alloys, and in particular to stainless steel alloys having a high resistance to corrosion and stress corrosion cracking in high-temperature water. As used herein, the term "high-temperature water" means water of about 150° C. or greater, steam, or the condensate thereof. As used herein, the term "stress corrosion cracking" means cracking propagated by static or dynamic stressing in combination with corrosion at the crack tip.

High-temperature water can be found in a variety of known apparatus, such as water deaerators, nuclear reactors, and in steam driven central station power generation. Corrosion and stress corrosion cracking are known phenomena occurring in the components, including structural members, piping, fasteners, and weld deposits, of apparatus exposed to high-temperature water. For example, the components in nuclear reactors exposed to high-temperature water are known to undergo stress corrosion cracking. The reactor components are subject to a variety of stresses associated with, e.g., differences in thermal expansion, the operating pressure needed for the containment of the reactor cooling water, and other sources including residual stress from welding, cold work and other asymmetric metal treatments. In addition, water chemistry, welding, heat treatment, and radiation can increase the susceptibility of a component to stress corrosion cracking of the metal.

Irradiation of stainless steel alloys in the core of nuclear reactors can promote stress corrosion cracking from the segregation of impurities, such as phosphorus, silicon and sulfur, to the grain boundaries. Irradiation-assisted stress corrosion cracking has been reduced by restricting such impurities in stainless steel alloys. Thus, modified forms of such alloys as 348, 316, and 304 stainless steel (using the official classification system of the American Society of Testing and Materials) have been developed with upper limits on phosphorus, silicon and sulfur below the limits of the standard alloys. In U.S. Pat. No. 4,836,976, further reduction in susceptibility to irradiation-assisted stress corrosion cracking was achieved by limiting the nitrogen content of austenitic stainless steels to a maximum of 0.05 weight percent.

Corrosion that leads to stress corrosion cracking has been widely studied and a number of papers have been written concerning it. Some of the publications addressing stress corrosion cracking and incorporated by reference herein are:

1) F. P. Ford, "Stress Corrosion Cracking", in *Corrosion Processes*, edited by R. N. Parkins, Applied Science Publishers, New York, 1982, p. 271.

2) J. N. Kass and R. L. Cowan, "Hydrogen Water Chemistry Technology for BWRs", in *Proc. 2nd Int. Conf on Environmental Degradation of Materials in Nuclear Power Systems—Water Reactors*, Monterey, Calif., 1985, p. 211.

3) M. E Indig, B. M. Gordon, R. B. Davis and J. E. Weber, "Evaluation of In-Reactor Intergranular Stress" in *Proc. 2nd Int. Conf on Environmental Degradation of Materials in Nuclear Power Systems—Water Reactors*, Monterey, Calif., 1985, p. 411.

b 4) F. P. Ford, P. L. Andresen, H. D. Solomon, G. M. Gordon, S. Ranganath, D. Weinstein, and R. Pathania, "Application of Water Chemistry Control, On-Line Monitoring and Crack Growth Rate Models for Improved BWR Materials Performance", Proc. Fourth International Symposium on Environmental Degradation of Materials in Nuclear Power Systems—Water Reactors, Jekyll Island, Ga., August 1989, Nace, Houston, pp 4–26 to 4–51, 1990.

5) L. W. Niedrach and W. H. Stoddard, "Corrosion Potentials and Corrosion Behavior of AISI304 Stainless Steel In High Temperature Water Containing Both Dissolved Hydrogen and Oxygen", *Corrosion*, Vol. 42, No. 12 (1986) page 696.

It is well documented that stress corrosion cracking occurs at higher rates when oxygen is present in the reactor water in concentrations of about 5 parts per billion, ppb, or greater. Stress corrosion cracking is further increased in a high radiation flux where oxidizing species, such as oxygen, hydrogen peroxide, and short-lived radicals are produced from radiolytic decomposition of the reactor water. Such oxidizing species increase the electrochemical corrosion potential of metals. Electrochemical corrosion is caused by a flow of electrons from anodic and cathodic areas on metallic surfaces. The corrosion potential is a measure of the thermodynamic tendency for corrosion phenomena to occur, and is a fundamental parameter in determining rates of, e.g., stress corrosion cracking, corrosion fatigue, corrosion film thickening, and general corrosion.

As explained in these and other articles, stress corrosion cracking in boiling water nuclear reactors and the associated water circulation piping has been reduced by injecting hydrogen in the water circulated therein. The injected hydrogen reduces oxidizing species in the water, such as dissolved oxygen, and as a result lowers the corrosion potential of metals in the water. However, factors such as variations in water flow rates and the time or intensity of exposure to neutron or gamma radiation result in the production of oxidizing species at different levels in different reactors. Thus, varying amounts of hydrogen have been required to reduce the level of oxidizing species sufficiently to maintain the corrosion potential below a critical potential required for protection from the stress corrosion cracking in the high-temperature water.

As used herein, the term, "critical potential" means a corrosion potential at or below a range of values of about −230 to −300 mV based on the standard hydrogen electrode (she) scale. Below the critical potential, stress corrosion cracking is markedly reduced or even eliminated as disclosed in references 2–5. Stress corrosion cracking proceeds at an accelerated rate in systems in which the electrochemical potential is above the critical potential, and at a substantially lower rate in systems in which the electrochemical potential is below the critical potential. Water containing oxidizing species such as oxygen increases the corrosion potential of metals exposed to the water above the critical potential, while water with little or no oxidizing species present results in corrosion potentials below the critical potential.

Corrosion potentials of stainless steels in contact with reactor water containing oxidizing species can be reduced below the critical potential by injection of hydrogen into the water in a concentration of about 50 to 100 ppb or greater. Much higher hydrogen injection levels are necessary to reduce the corrosion potential within the high radiation flux of the reactor core, or when oxidizing cationic impurities, e.g., cupric ion are present. Such hydrogen injection lowers the concentration of dissolved oxidizing species in the water and also the corrosion potential of the metal. However, high hydrogen additions, for example of about 150 ppb or greater, that reduce the corrosion potential below the critical potential can result in a higher radiation level in the steam driven turbine section from incorporation of the short-live $N^{16}$ species. The higher radiation requires additional shielding, and radiation exposure control.

Accordingly, although the addition of hydrogen lowers the corrosion potential of reactor water, it is also desirable to limit the amount of hydrogen in reactor water, while maintaining the corrosion potential below the critical potential.

In the article, "Increasing Passivation Ability and Corrosion Resistance of Stainless Steel by Surface Alloying with Palladium," G. P. Chernova, T. A. Fedosceva, L. P. Kornienko, and N. D. Tomashov, *Prot. Met.* (Eng. Transl.) 17 (1981) page 406, the electrochemical behavior and increase in corrosion potential and passivation of stainless steel that is surface alloyed with palladium, and exposed to deaerated acidic solutions is disclosed. The increased corrosion potential causes a passive oxide layer to form on the stainless steel that reduces further corrosion.

One object of this invention is to provide a stainless steel alloy having improved resistance to corrosion and stress corrosion cracking in high-temperature water.

Another object is to provide a stainless steel alloy comprised of high-chromium that reduces corrosion of grain boundaries within components formed from the alloy and exposed to high-temperature water.

Another object is to provide a high-chromium stainless steel alloy comprised of titanium, tantalum, niobium, or mixtures thereof that reduces corrosion of grain boundaries within components formed from the alloy and exposed to high-temperature water.

Another object is to provide a high-chromium stainless steel alloy comprised of a platinum group metal that reduces the corrosion potential of the alloy in high-temperature water.

Another object is to provide a method for reducing stress corrosion cracking of a component exposed to high-temperature water by lowering the corrosion potential of the component.

BRIEF DESCRIPTION OF THE INVENTION

We have discovered a high-chromium stainless steel alloy having improved resistance to corrosion and stress corrosion cracking in high-temperature water comprised of, in weight percent; about 22 to 32 percent chromium, about 16 to percent nickel, up to about 10 percent manganese, up to about 0.06 percent carbon, and the balance substantially iron. As used herein, the term "balance substantially iron" means the remaining weight percent of the alloy is comprised substantially of iron, however, other elements which do not interfere with achievement of the resistance to corrosion and stress corrosion cracking, or mechanical properties of the alloy may be present as impurities or up to non-interfering levels. Impurity amounts of phosphorous, sulfur, silicon, and nitrogen should be limited to, about 0.005 weight percent or less of phosphorous or sulfur, and about 0.2 weight percent or less of silicon or nitrogen.

A preferred high-chromium alloy is further comprised of about 2 to 9 weight percent of a metal from the group consisting of titanium, niobium, tantalum, and mixtures thereof. Another preferred high-chromium alloy is further comprised of a platinum group metal in an effective amount to reduce the corrosion potential of the alloy in high-temperature water provided with hydrogen As used herein, the term "platinum group metal" means metals from the group consisting of platinum, palladium, osmium, ruthenium, iridium, rhodium, and mixtures thereof.

The method of this invention reduces corrosion on components exposed to high-temperature water. Oxidizing species such as oxygen or hydrogen peroxide are present in such high-temperature water. In nuclear reactors, corrosion is further increased by higher levels of oxidizing species, e.g. up to 200 ppb or greater of oxygen in the water, from the radiolytic decomposition of water in the core of the nuclear reactor. The method comprises providing a reducing species in the high-temperature water that can combine with the oxidizing species, and forming the component from a stainless steel alloy comprised of, in weight percent; about 24 to 32 percent chromium, about 20 to 40 percent nickel, about 1 to 10 percent manganese, an effective amount of a platinum group metal to reduce the corrosion potential of the component below the critical potential when exposed to the water, and the balance substantially iron.

BRIEF DESCRIPTION OF THE DRAWINGS

The following description will be understood with greater clarity if reference is made to the following drawings.

DETAILED DESCRIPTION OF THE INVENTION

Figure 1:
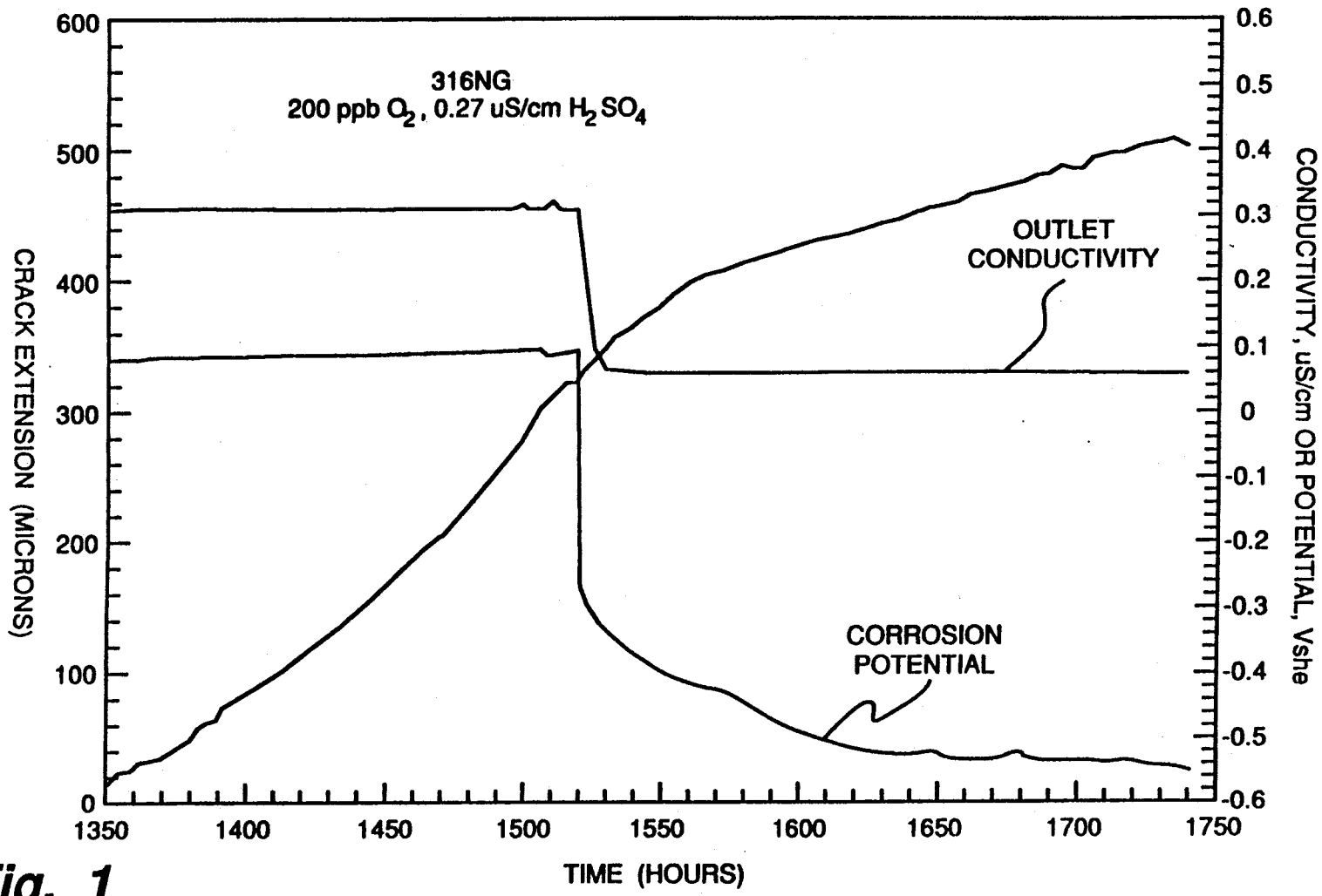
FIGS. 1–3 are graphs plotting the measured crack length extension in precracked test samples loaded under various conditions over a period of time, and exposed to high-temperature water. The corrosion potential and conductivity of the water were varied by introducing oxygen or sulfuric acid into the water, and the change in corrosion potential and conductivity of the water is plotted on the abscissa on the right side of the graphs.

Intergranular stress corrosion cracking of the components in nuclear reactors is heightened by long term irradiation. It is known the long term exposure to radiation induces changes at the grain boundaries of materials by the action of radiation segregation. Radiation segregation results from the displacement of atoms from high energy particles impinging on the atoms and leaving vacancies. The displaced atoms and associated vacancies diffuse to locations such as grain boundaries, resulting in compositional gradients near the grain boundaries. Such radiation segregation renders existing materials susceptible to stress corrosion cracking. Additionally, the high radiation flux creates a more aggressive or corrosive water chemistry by the radiolytic decomposition of water into oxidizing species such as oxygen and hydrogen peroxide. The dissolved products of radiolysis elevate the corrosion potential of metal exposed to the water, and thereby increase the driving force for stress corrosion cracking. Alloys of this invention can be used to form components exposed to high-temperature water, such as components in deaerators, steam driven power generators, and light water nuclear reactors, including both pressurized water reactors and boiling water reactors. For example, the alloy of this invention can be used to form core components of of boiling water reactors, including for example, fuel and absorber rod cladding, neutron source holders, and top guides.

The high-chromium stainless steel alloy of this invention is an austenitic stainless steel. Alloys of the invention are comprised of a high-chromium of about 22 to 32 weight percent to minimize corrosion in the grain boundaries of the alloy. Below about 22 weight percent chromium, the alloy has a lower resistance to stress corrosion cracking in high-temperature water when corrosion potential and conductivity are increased. In addition, below about 22 weight percent chromium irradiation segregation can deplete the grain boundaries of chromium to the point where the grain boundaries become more susceptible to corrosion and stress corrosion cracking. To maintain the alloy stable in the austenite phase, nickel is provided at about 16 to 40 weight percent. Below about 16 weight percent nickel the alloy does not remain stable in the austenite phase, and ductility, weldability, and toughness of the alloy are diminished. Manganese is another austenite stabilizing element and may be present up to about 10 weight percent. Carbon stabilizes the austenite phase and strengthens the alloy, and may be present up to about 0.06 weight percent, preferably, about 0.01 to 0.03 weight percent.

A preferred high-chromium stainless steel alloy is further comprised of about 2 to 9 weight percent of a metal from the group consisting of titanium, niobium, tantalum, or mixtures thereof. The titanium, niobium, and tantalum help prevent corrosion at the grain boundaries of the alloy. Below about 2 weight percent of the metals, the grain boundaries can become depleted in the metals after long term exposure to radiation. Above about 9 weight percent of the metals, formation of undesirable phases such as the brittle mu phase occurs, and toughness and ductility are diminished.

Preferably, the high-chromium alloys are heat treated to enrich the grain boundaries in chromium, titanium, niobium, or tantalum. Annealing at about 1050° C. to 1200° C. for about ten to thirty minutes provides such enrichment at the grain boundaries. Depending upon the size of the component formed from the alloy, annealing time may be increased to heat the entire cross section of the component for the ten to thirty minute period.

We have found that a platinum group metal in the alloy catalyzes the combination of reducing species, such as hydrogen, with oxidizing species, such as oxygen or hydrogen peroxide, that are present in the water. Such catalytic action at the surface of components formed from the alloy can lower the corrosion potential of the alloy below the critical corrosion potential where stress corrosion cracking is minimized. As a result, the efficacy of hydrogen additions to high-temperature water in lowering the electrochemical potential of components made from the alloy and exposed to the injected water is increased many fold.

Further, we have found that relatively small additions of the platinum group metal in the alloy are sufficient to provide the catalytic activity at the surface of components formed from the alloy. For example, we have found that about 0.01 weight percent, preferably at least 0.1 weight percent of the platinum group metal provides catalytic activity sufficient to lower the corrosion potential of the alloy below the critical potential. Preferably, the platinum group metal is present below an amount that substantially impairs the metallurgical properties, including strength, ductility, and toughness of the alloy. The platinum group metal can be provided by methods known in the art, for example by addition to a melt of the alloy, or by surface alloying as shown for example in the reference cited above "Increasing the Passivation Ability and Corrosion Resistance of Chromium Steel by Surface Alloying With Palladium," and incorporated herein by reference.

Because very small surface concentrations are adequate to provide the catalytic layer and reduce the corrosion potential of the metal, the processing, physical metallurgical or mechanical properties of the alloys, and components formed therefrom are not significantly altered. Lower amounts of reducing species such as hydrogen are effective to reduce the corrosion potential of the metal components below the critical potential, because the efficiency of combination of oxidizing and reducing species is increased many fold by the catalytic layer. For example, the corrosion potential of a metal component having a catalytic layer of a platinum group metal, and exposed to water comprised of 200 ppb oxygen can be reduced below the critical potential by the addition of about 25 ppb hydrogen to the water. In contrast, the corrosion potential of a metal component exposed to water comprised of 200 ppb oxygen, the component not having a catalytic layer of a platinum group metal, can be reduced below the critical potential by the addition of about 100 ppb hydrogen to the water, i.e., an increase of 400 percent in hydrogen that must be added to the water.

Reducing species that can combine with the oxidizing species in the high temperature water are provided by conventional means known in the art, for example, see "Water Chemistry of Nuclear Power Plants", W. T. Lindsay, Jr., Proceeding Second International Conference on Environmental Degradation of Materials in Nuclear Power Systems—Water Reactors, Monterey, Calif., 1985, pp. 203–210, incorporated herein by reference. Briefly described, reducing species such as hydrogen, ammonia, or hydrazine are injected into the feedwater of the nuclear reactor. Reducing species are also provided within the core of a nuclear reactor by the radiolytic decomposition of water. Therefore, within the reactor core enough hydrogen may be produced by the radiolytic decomposition of water to lower the corrosion potential below the critical potential in combination with the catalytic activity provided by the catalytic layer of a platinum group metal on components within the reactor core. Recirculated core water can be sampled to determine the level of hydrogen provided by such radiolytic decomposition. If necessary, additional hydrogen is injected in the feed water of the nuclear reactor to reduce the corrosion potential of the components exposed to the high-temperature water below the critical potential.

Additional features and advantages of the high-chromium alloys are shown by the following examples.

EXAMPLE 1

A sample of commercial alloy 316, in the form of about 4 centimeter thick plate, was obtained from Sumitomo Metals, Japan. Samples of the commercial alloy 304, and the high-chromium alloy of this invention were prepared by first melting 25 kilogram charges in a vacuum furnace. The composition of the samples is shown in Table 1 below.

TABLE 1

| Test No. | Alloy | Stainless Steel Alloy Compositions (Weight Percent) Cr | Ni | Mo | Si | Mn | C | N | P | S |
|---|---|---|---|---|---|---|---|---|---|---|
| 1. | 316 NG | 17.15 | 12.9 | 2.48 | 0.50 | 1.74 | 0.018 | 0.083 | 0.020 | 0.001 |
| 2. | 304 L | 19.21 | 9.03 | <0.005 | 0.03 | 1.11 | 0.0046 | 0.0031 | <0.005 | 0.0051 |
| 3. | Hi Cr | 24.47 | 23.86 | | <0.02 | 1.18 | | 0.0048 | | 0.004 |

The melts were poured to form 10.2 centimeter tapered square ingots about 30 centimeters long that were forged at 1000° C., homogenized at 1200° C. for sixteen hours, and hot rolled at 900° C. to form plates having a thickness of about 2.8 centimeters. Test samples were machined from the plates into standard 1 inch compact geometries in conformance with ASTM E 399, "Standard Test Method for Plane-Strain Fracture Toughness of Metallic Materials," 1990 ANNUAL BOOK OF ASTM STANDARDS, Vol. 03.01. The test samples were precracked, and instrumented for crack monitoring using reversed DC potential drop methods, shown for example in U.S. Pat. Nos. 4,924,708 and 4,677,855, incorporated herein by reference. The instrumented test samples were placed in an autoclave. The autoclave was part of a test loop which had been set up for a series of water chemistry studies. A pump circulated water through the autoclave. The system was brought to a temperature of about 288° C. and a pressure of about 1500 psig.

Figure 2:
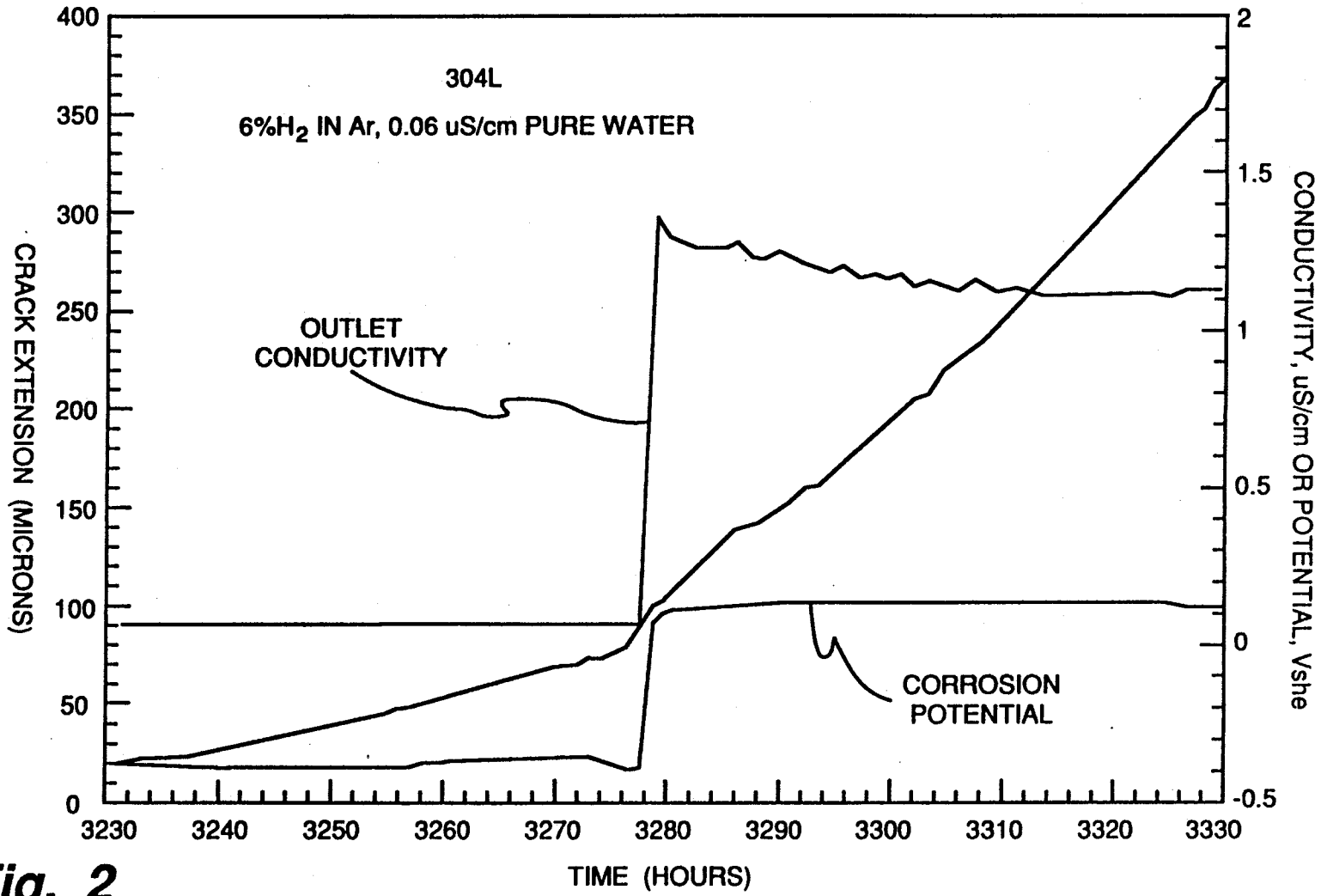
Figure 3:
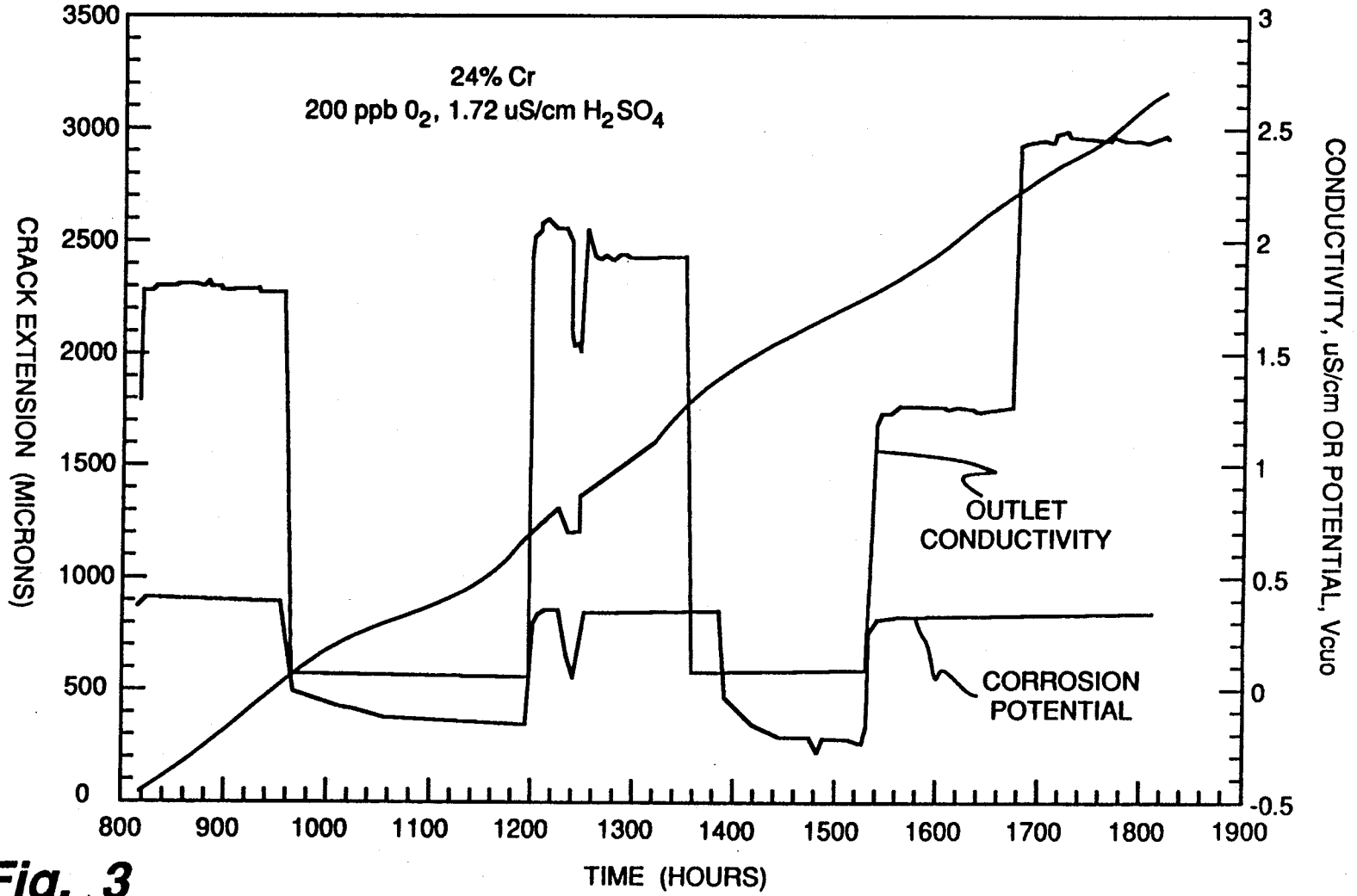

Water comprised of about 150 ppb (parts per billion) of dissolved hydrogen was circulated to flow over the specimens at a flow rate of about 200 milliliters per minute. Loads were applied to the precracked test samples using closed loop, servo hydraulic mechanical testing machines under several conditions. In a first test a maximum crack tip stress intensity of 33 megapascals square root meter, MPa $\sqrt{m}$, was applied to the test sample prepared from test no. 1 in Table 1. Every 1000 seconds the load was cycled to decrease the maximum stress intensity by half, and increased back to the maximum stress intensity over a period of 100 seconds. In a second test a maximum stress intensity of 33 MPa $\sqrt{m}$ was applied to the test sample prepared from test no. 2 in Table 1, and every 1000 seconds the load was cycled to decrease the stress intensity by one third the maximum, and increased back to the maximum stress intensity over a period of 100 seconds. In a third test the test sample prepared from test no. 3 in Table 1 was loaded as in the second test, but in addition every 100th cycle the stress intensity was reduced to 30 percent of the maximum stress intensity and increased back to the maximum stress intensity over a period of 100 seconds. The crack extension measured on the samples in the first, second, and third tests is shown in FIGS. 1-3. FIGS. 1-3 are graphs in which the crack extension in microns in the precracked test sample is plotted on the left abscissa, versus the time in hours, plotted on the ordinate, that the load was applied to the test sample.

In each test, the crack growth rate versus time was monitored as the water chemistry was changed by introducing water with 200 parts per billion oxygen, or water comprised of various amounts of sulfuric acid and 200 parts per billion oxygen. Corrosion potential measurements using a zirconia reference electrode as described in L. W. Niedrach and N. H. Stoddard, Corrosion, Vol. 41, No. 1, 1985, page 45, incorporated herein by reference, were made and the data was plotted on the rightmost abscissa of the graphs in FIGS. 1-3. The water conductivity at the inlet and outlet of the autoclave was also measured using a standard conductivity meter, model PM-512 Barnstead Co., and plotted on the rightmost abscissa of the graphs in FIGS. 1-3. In FIGS. 1-3 the increases in corrosion potential and conductivity correspond to the addition of water comprised sulfuric acid and 200 parts per billion oxygen to the water circulated in the autoclave.

FIGS. 1-2 show that the rate of stress corrosion cracking of 316 and 304 stainless steel exposed to high-temperature water is sensitive to changes in corrosion potential and conductivity in the water. FIG. 1 shows that the rate of stress corrosion cracking in 316 stainless steel is accelerated when corrosion potential and conductivity are increased. Conversely, when corrosion potential and conductivity are decreased the stress corrosion cracking rate decreases. FIG. 2 shows a similar behavior for 304 stainless steel. When corrosion potential and conductivity are low, the stress corrosion cracking rate of 304 stainless steel is low, but when conductivity and corrosion potential are increased the stress corrosion cracking rate increases. FIG. 3 shows that the high-chromium alloys of this invention are relatively insensitive to changes in corrosion potential and conductivity. As corrosion potential and conductivity increase or decrease the rate of stress corrosion cracking remains substantially constant. In other words, the low rate of stress corrosion cracking in the alloys of this invention that occurs in high-temperature water having low corrosion potential and low conductivity is maintained when corrosion potential and conductivity are increased.

EXAMPLE 2

A series of test samples were prepared by melting 20 kilogram charges in a vacuum furnace, and forming the melts into sheets as described in Example 1. The composition of each charge is shown in Table 2 below. Tensile specimens were machined from the plates, and the yield strength, tensile strength, and percentage elongation for the specimens were measured in accordance with ASTM E 8 "Standard Test Methods of Tension Testing of Metallic Materials," 1990 ANNUAL BOOK OF ASTM STANDARDS, Vol. 03.01, and are shown in Table 2 below. Typical tensile values for 304 stainless steel are shown for comparison in Table 2.

TABLE 2

Tensile Properties of High-Chromium Stainless Steels

| Test No. | Composition (wt. percent) Cr | Ni | Ti | Nb | Ta | Y.S. ksi | U.T.S ksi | El. % |
|---|---|---|---|---|---|---|---|---|
| 1. | 30 | 35 | | | | 70.3 | 73.8 | 6.2 |
| 2. | 30 | 35 | 0.5 | 0.5 | 0.5 | 45.5 | 88.9 | 42.8 |
| 3. | 30 | 35 | 1.0 | 1.0 | 1.0 | 86.5 | 95.0 | 16.3 |
| 4. | 30 | 35 | 2.0 | 2.0 | 2.0 | 77.8 | 93.9 | 23.2 |
| 5. | 30 | 35 | 0.5 | 2.0 | 1.0 | 74.5 | 97.7 | 25.0 |
| 304 SS* | 18.5 | 9 | | | | 35 | 82 | 60 |

*Typical values, also contains about 1.2% Mn.

The tensile testing results in Table 2 show that the alloys of this invention have good strength and adequate ductility.

EXAMPLE 3

Test samples were prepared by melting 1.03 or 20 kilogram charges comprised of, in weight percent; about 18 percent chromium, 9.5 percent nickel, 1.2 percent manganese, 0.5 percent silicon, and platinum or palladium ranging from about 0.01 to 3.0 percent as shown in Table 3 below. The composition of the test samples is similar to the composition of 304 stainless steel in Table 2, but are further comprised of a platinum or palladium solute. The charges were vacuum arc melted as cylindrical ingots about 8 centimeters in diameter by 2.1 centimeters in thickness, or were vacuum induction melted and poured into 10.2 centimeter tapered square ingots about 30 centimeters in length. The ingots were forged at 1000° C. to a thickness of about 1.9 centimeters, homogenized at 1200° C. for 16 hours, and hot rolled at 900° C. in two passes to final dimensions of about about 10 centimeters in diameter by 1.2 centimeters thick. Test specimens were fabricated by electro-discharge machining rods about 0.3 centimeter in diameter by 6 centimeters long from the samples. The test specimens were wet ground using 600 grit paper to remove the re-cast layer produced by the electro-discharge machining.

TABLE 3

Chemical Composition of 304 Stainless Steel Samples With Palladium or Platinum Addition

| Sample No. | Cr | Ni | Mn | Si | Pt | Pd |
|---|---|---|---|---|---|---|
| 1. | 18 | 9.5 | 1.2 | 0.5 | | 0.01 |
| 2. | 18 | 9.5 | 1.2 | 0.5 | | 0.035 |
| 3. | 18 | 9.5 | 1.2 | 0.5 | | 0.1 |
| 4. | 18 | 9.5 | 1.2 | 0.5 | | 0.35 |
| 5. | 18 | 9.5 | 1.2 | 0.5 | | 1.0 |
| 6. | 18 | 9.5 | 1.2 | 0.5 | | 3.0 |
| 7. | 18 | 9.5 | 1.2 | 0.5 | 0.035 | |
| 8. | 18 | 9.5 | 1.2 | 0.5 | 0.1 | |
| 9. | 18 | 9.5 | 1.2 | 0.5 | 0.35 | |
| 10. | 18 | 9.5 | 1.2 | 0.5 | 1.0 | |
| 11. | 18 | 9.5 | 1.2 | 0.5 | 3.0 | |

A test specimen prepared from sample number 10 in Table 3 was welded to a Teflon insulated 0.76 millimeter stainless steel wire and mounted in a Conax fitting for placement in an autoclave. The test specimen mounted on a Conax fitting was transferred to a test loop which had been set up for a series of water chemistry studies. The Conax mounted coupon was placed in the autoclave along with a specimen of 316 stainless steel, and a platinum reference electrode specimen. A pump circulated water through the autoclave. The system was brought to a temperature between 280° and 285° C., 1200 psig. pressure, and water containing 350 ppb of dissolved oxygen was circulated to flow over the specimens at a flow rate of 200 milliliters per minute. After two to three days of operation potential readings were taken and hydrogen was gradually introduced into the water at increasing concentrations over a period of days.

Figure 4:
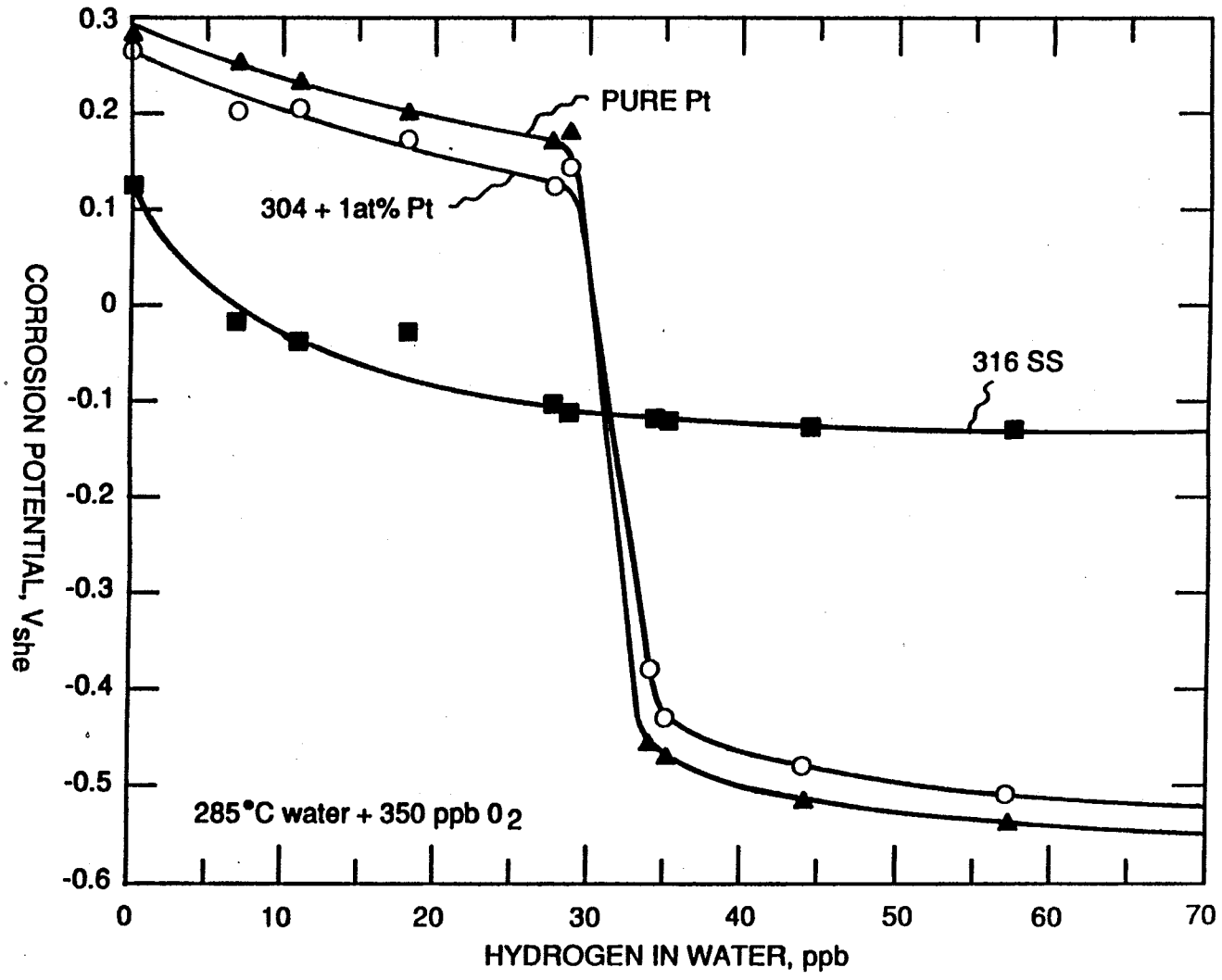
FIG. 4 is a graph of the corrosion potential of samples of pure platinum, stainless steel, and stainless steel comprised of 1 atomic percent platinum in water at 285° C. with 350 parts per billion oxygen plotted against increasing hydrogen concentration in the water.

Corrosion potential measurements using a zirconia reference electrode as described in Example 1 were made and data were plotted on a graph as depicted in FIG. 4. FIG. 4 is a graph in which the corrosion potential is plotted against the concentration of hydrogen in the test water in parts per billion. The potentials of the specimens and the platinum electrode, converted to the standard hydrogen electrode (SHE) scale, are shown as the three separate plots representing the three different specimens on FIG. 4. As indicated by the legend, the filled squares correspond to the electrical potential of the 316 stainless steel sample with no palladium; the filled triangles to the platinum reference electrode; and the open circles to the stainless steel specimens comprised of 1 atomic percent platinum.

The yield strength, tensile strength, and percentage elongation for samples 1, 3, 4 and 7 were measured in accordance with ASTM E 8 "Standard Test Methods of Tension Testing of Metallic Materials," 1990 Annual Book of ASTM Standards, Vol. 3.01, and are shown in Table 4 below. Typical tensile properties for 304 stainless steel are shown in Table 4 for comparison.

TABLE 4

Tensile Properties of 304 Stainless Steel With Platinum or Palladium Addition

| Sample No. | Pt | Pd | Y.S. (ksi) | U.T.S. (ksi) | El (%) | Comments |
|---|---|---|---|---|---|---|
| 1. | | 0.01 | 37.9 | 87.4 | 45.6 | |
| 3. | 0.035 | | 26.8 | 87.8 | 65.6 | |
| 4. | | 0.1 | 31.1 | 89.7 | 55.1 | |
| 5. | | 0.35 | 37.7 | 89.4 | 59.4 | |
| 304 SS | | | 35 | 82 | 60 | Typical Tensile Properties |

EXAMPLE 4

Figure 5:
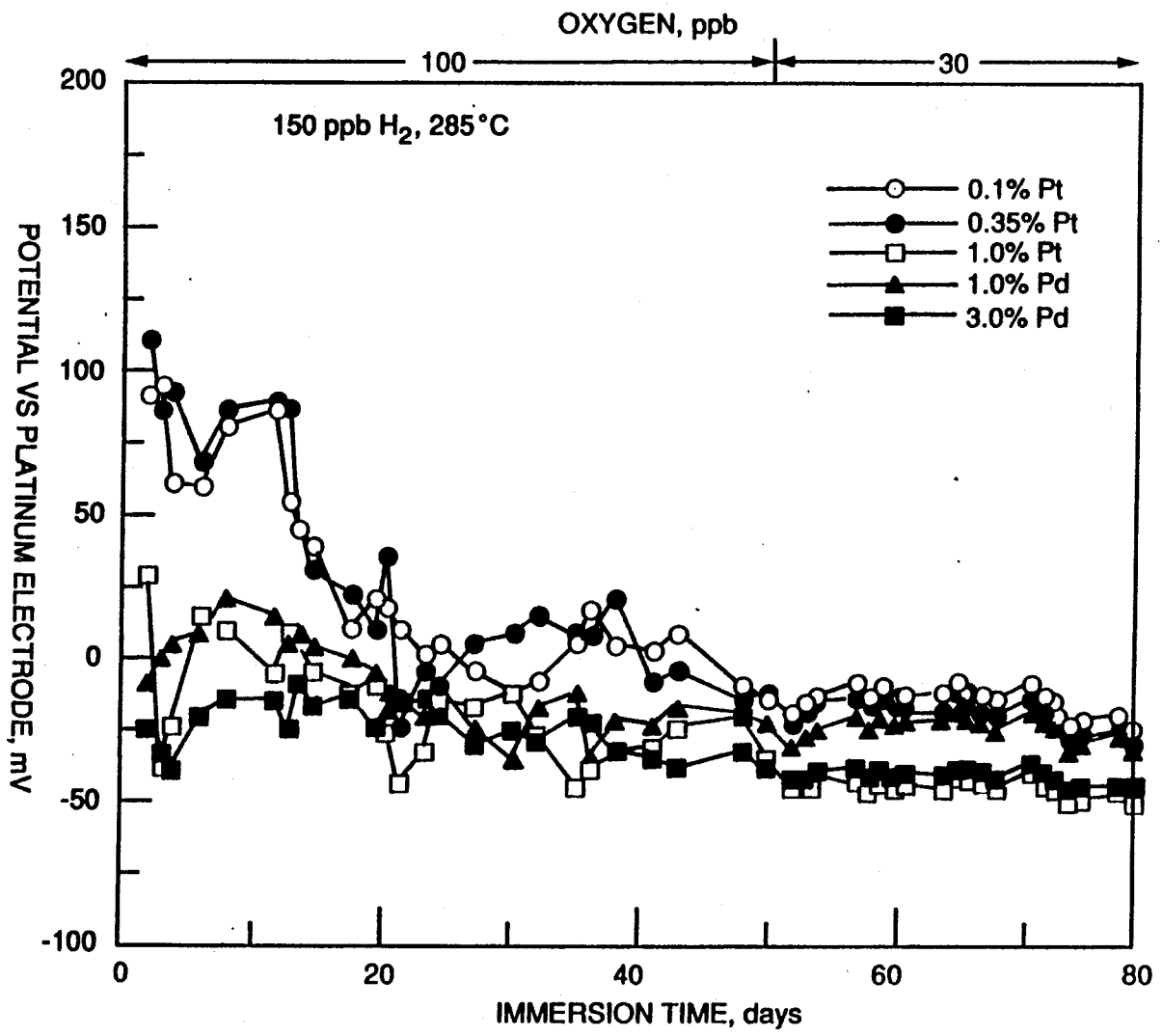
FIGS. 5–7 are graphs of the corrosion potential of samples of stainless steel comprised of a platinum or palladium solute versus a pure platinum electrode in water at 285° C. with 150 parts per billion hydrogen plotted over a period of time.
Figure 6:
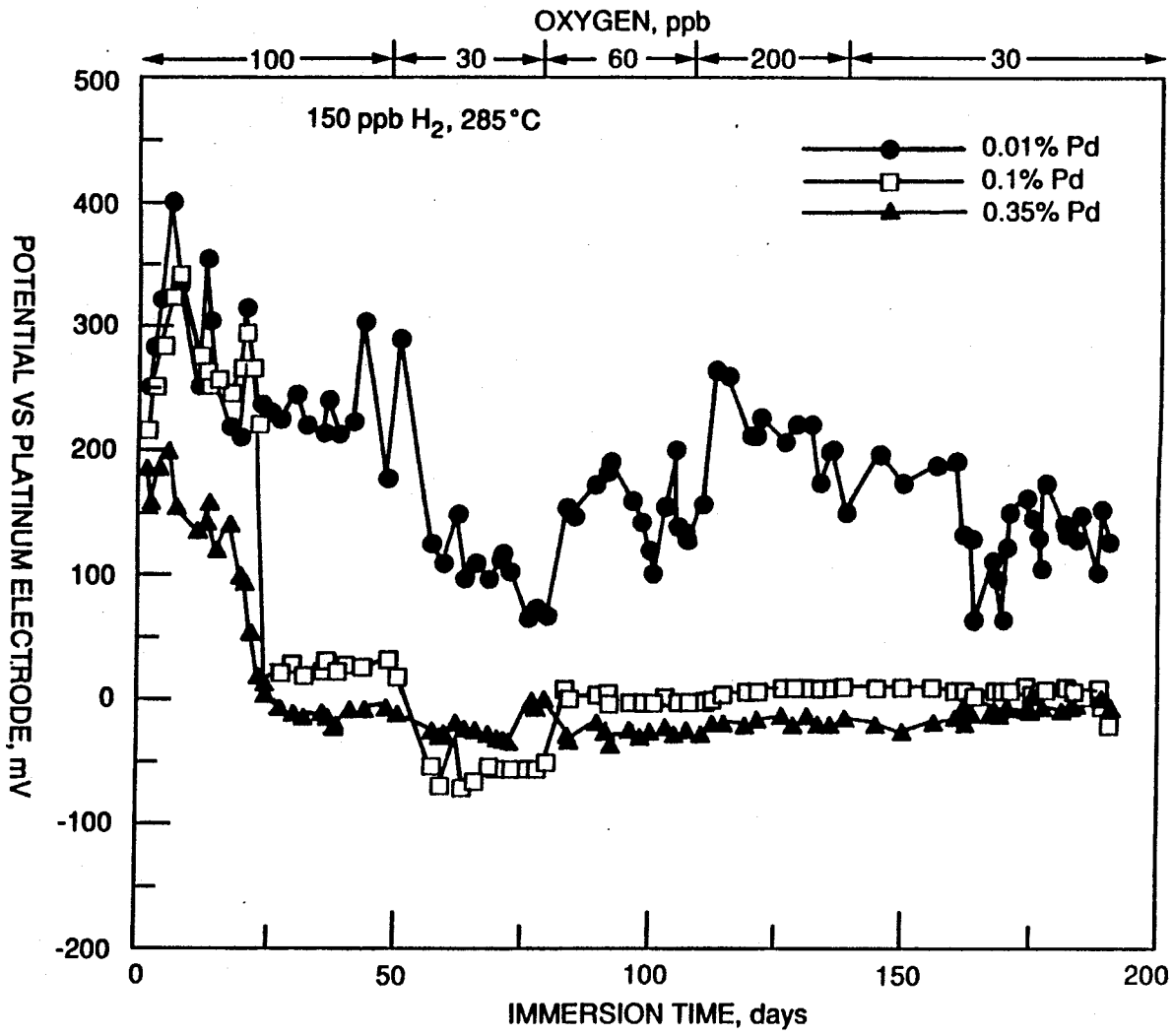
Figure 7:
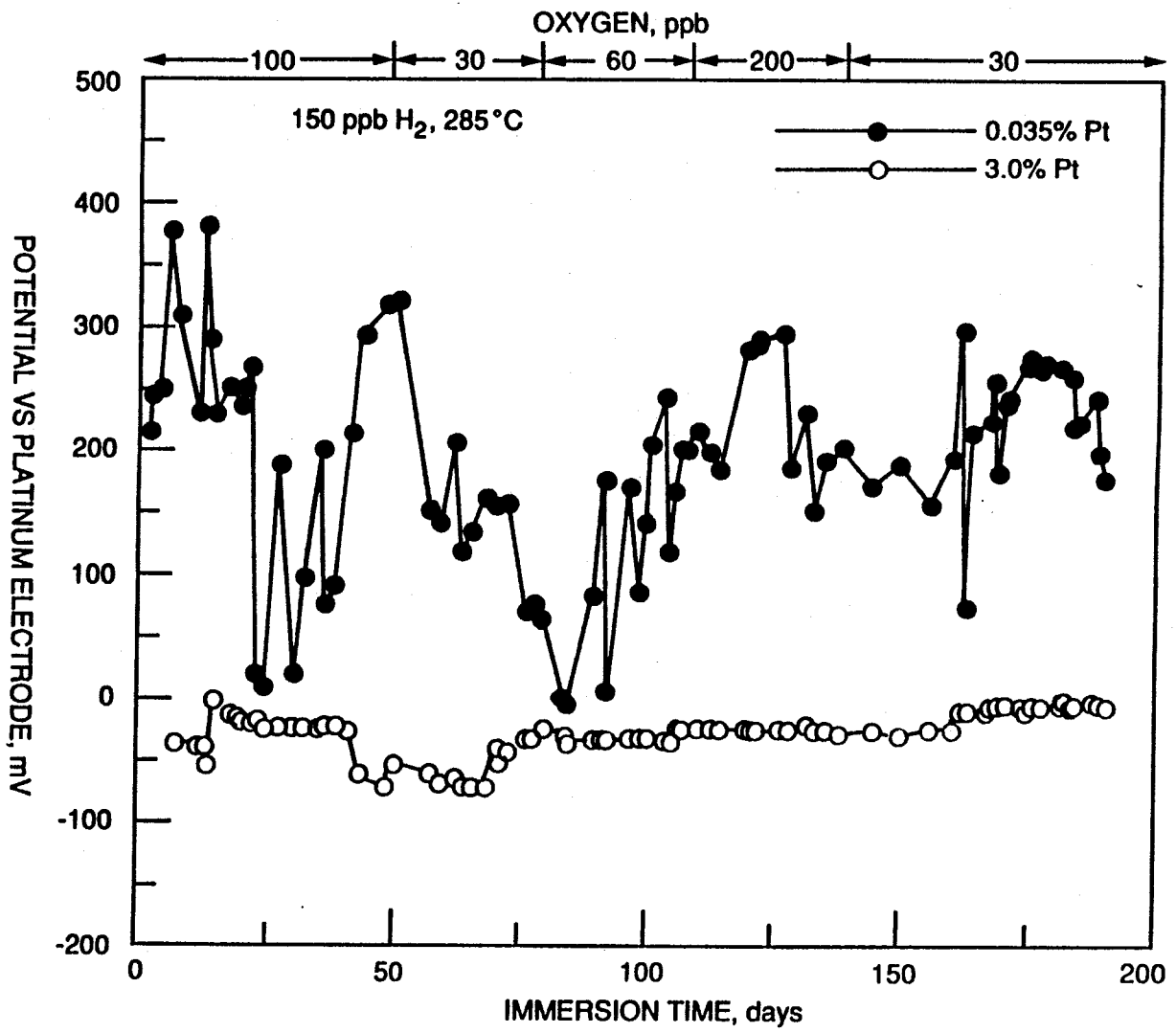

The effectiveness of the low levels of palladium or platinum solute, in test samples 1-11 from Example 3, in reducing corrosion potential was demonstrated in a series of tests. Test specimens were prepared and the corrosion potential was measured in the 285° C. water test loop as described in Example 3, however the ratio of dissolved hydrogen to dissolved oxygen in the water was varied. Results of the corrosion testing are shown in FIGS. 5-7. FIGS. 5-7 are graphs of the corrosion potential measured on the samples as compared to the platinum reference electrode, i.e. 0 is the corrosion potential of the platinum reference electrode. The oxygen level was reduced and increased in a step-wise manner over a period of days while hydrogen was maintained at 150 ppb as shown in FIGS. 5-7. The results clearly show that the alloys containing additions of palladium or platinum as low as 0.1% have a low corrosion potential about the same as the pure platinum electrode, although a short "ageing" period may be required before the surface becomes fully catalytic. Lower levels of 0.035% to 0.01% of palladium or platinum required longer "ageing" periods and reduce the corrosion potential below the critical potential.

The yield strength, tensile strength, and percentage elongation for samples 1, 3, 4 and 7 shown in Table 4, are substantially equivalent to the typical values for type 304 stainless steel shown at the bottom of Table 4.

Small amounts of a platinum group metal as a solute in an alloy can impart improved resistance to corrosion and stress corrosion cracking in high-temperature water. These additions modify the surface catalytic properties of the metal, decreasing the corrosion potential in the presence of dissolved hydrogen in water containing dissolved oxygen or other oxidents. With dissolved hydrogen provided at a sufficient level to combine with the dissolved oxygen, the corrosion potential decreases to about $-0.5\ V_{she}$. The corrosion tests from Example 3 in 350 ppb dissolved oxygen show that even at levels of dissolved hydrogen slightly below what is needed to combine with the dissolved oxygen, i.e. 32 ppb, the corrosion potential drops dramatically from about 0.15 to about $-0.5\ V_{she}$ as shown in FIG. 4. Note that about 350 parts per billion of oxygen requires about 44 parts per billion of hydrogen for complete combination of the oxygen to form water.

In the absence of the palladium or platinum additions, much higher levels of dissolved hydrogen of about 100 to 150 ppb must be added during operation of boiling water reactors to suppress the dissolved oxygen concentration typically below 10 ppb, providing a reduction in corrosion potential from about 0.1 to about $-0.3\ V_{she}$. Since the corrosion potential is a fundamental parameter which controls susceptibility to stress corrosion cracking, alloys comprised of a platinum group metal solute provide greater resistance to cracking at much lower hydrogen addition levels, as has been demonstrated directly in laboratory stress corrosion cracking tests. This can translate to significant benefits in reducing the amount of hydrogen additions, and in reduced incorporation of $N^{16}$.

From FIGS. 5–7 it is evident that the alloys having a platinum or palladium solute reached low potentials under the catalyzed hydrogen water chemistry conditions and had a corrosion potential essentially equivalent to the potential of the platinum electrode. Both were below the range of critical potential of $-230$ mV to $-300$ mV for the prevention of stress corrosion cracking. The data obtained from the examples and plotted in FIG. 4–7 clearly demonstrate the effectiveness of the platinum or palladium solute in the stainless steel alloy. Although the effectiveness of the platinum or palladium solute in reducing corrosion potential has been shown above in 304 stainless steel, it is believed the platinum group metal will have the same catalytic effect in the alloys of this invention. The platinum or palladium solute is deemed to be representative of any of the platinum group metals.

What is claimed is:

1. A corrosion resistant stainless steel alloy comprised of, in weight percent, about 24 to 32 percent chromium, about 20 to 40 percent nickel, up to about 10 percent manganese, up to about 0.06 percent carbon, a platinum group metal in an effective amount to reduce the corrosion potential of the alloy in high-temperature water provided with hydrogen, about 2 to 9 percent of at least one of the metals titanium, niobium, or tantalum, and the balance substantially iron.

2. An alloy according to claim 1 wherein the platinum group metal is about 0.01 to 5 atomic percent of the alloy.

* * * * *